US008816581B2

(12) United States Patent
Hatano

(10) Patent No.: US 8,816,581 B2
(45) Date of Patent: Aug. 26, 2014

(54) LIGHTING DEVICE

(75) Inventor: Kaoru Hatano, Kanagawa (JP)

(73) Assignee: Semiconductor Energy Laboratory Co., Ltd. (JP)

( * ) Notice: Subject to any disclaimer, the term of this patent is extended or adjusted under 35 U.S.C. 154(b) by 114 days.

(21) Appl. No.: 13/367,886

(22) Filed: Feb. 7, 2012

(65) Prior Publication Data

US 2012/0206038 A1 Aug. 16, 2012

(30) Foreign Application Priority Data

Feb. 10, 2011 (JP) ..... 2011-027135

(51) Int. Cl.
*H01J 1/62* (2006.01)

(52) U.S. Cl.
USPC ..... 313/506; 313/505

(58) Field of Classification Search
CPC ..... H01L 27/3216; H01L 27/3218; H01L 2251/5361; H05B 33/10; H05B 33/14; H05B 33/145; B60K 2350/2034
USPC ..... 313/505, 506
See application file for complete search history.

(56) References Cited

U.S. PATENT DOCUMENTS

| | | | | |
|---|---|---|---|---|
| 6,576,926 | B1 | 6/2003 | Yamazaki et al. | |
| 6,967,129 | B2 | 11/2005 | Yamazaki et al. | |
| 7,365,393 | B2 | 4/2008 | Yamazaki et al. | |
| 7,442,991 | B2 | 10/2008 | Yamazaki et al. | |
| 7,745,829 | B2 | 6/2010 | Yamazaki et al. | |
| 8,030,659 | B2 | 10/2011 | Yamazaki et al. | |
| 2003/0184218 | A1 * | 10/2003 | Brost et al. | 313/506 |
| 2004/0251818 | A1 * | 12/2004 | Duggal et al. | 313/504 |
| 2005/0110028 | A1 * | 5/2005 | Park et al. | 257/88 |
| 2006/0017375 | A1 * | 1/2006 | Noguchi et al. | 313/504 |
| 2006/0135029 | A1 * | 6/2006 | Harada | 445/25 |
| 2010/0253222 | A1 * | 10/2010 | Koshihara | 315/32 |

FOREIGN PATENT DOCUMENTS

JP 2009-237573 10/2009

* cited by examiner

*Primary Examiner* — Andrew Coughlin
(74) *Attorney, Agent, or Firm* — Husch Blackwell LLP

(57) ABSTRACT

Provided is a lighting device capable of displaying a desired image without an element such as a TFT in a light-emitting portion of the lighting device. The lighting device includes a light-emitting portion in which a plurality of light-emitting segments arranged in matrix and each including an EL layer between a pair of electrodes (an anode and a cathode). The area of a light-emitting region is varied as appropriate so as to obtain a desired light-emitting luminance from the light-emitting region in each the light-emitting segment; accordingly, gray-scale display can be performed and a still image can be displayed only by 1 external power source.

14 Claims, 9 Drawing Sheets

LIGHTING DEVICE

BACKGROUND OF THE INVENTION

1. Field of the Invention

The present invention relates to a lighting device in which a still image can be displayed.

2. Description of the Related Art

A light-emitting element utilizing EL is currently used for a display device, a lighting device, and the like which include a display in which a moving image can be displayed. When a light-emitting element utilizing EL is used for a display device, the display device can have high visibility and can be thin and lightweight, which are great advantages. In addition, when a light-emitting element utilizing EL is used for a lighting device, since the light-emitting element can be formed in a film faun, a planar light emission can be easily obtained and the lighting device can be increased in size; these points are particularly effective.

Note that in a display device, there is a large expectation for moving image display, and in order to realize higher-definition image display, development in various fields such as a structure, a circuit design, a driving method, and the like of a TFT in a display region and the like as well as a light-emitting element has been conducted (for example, see Patent Document 1).

In addition, a lighting device is expected not just to brighten up a room with light but also to be used for space design and interior design.

REFERENCE

Patent Document

[Patent Document 1] Japanese Published Patent Application No. 2009-237573

SUMMARY OF THE INVENTION

In terms of expanding the range of uses of lighting devices, a lighting device capable of displaying a desired image like a display device is possible. However, the display function is not a main function in a lighting device; thus, a complex structure due to provision of an element such as a TFT or a driver circuit to display an image is not preferable.

In view of the above, an object of one embodiment of the present invention is to provide a lighting device capable of displaying a desired image without an element such as a TFT in a light-emitting portion of the lighting device.

One embodiment of the present invention is a lighting device. A light-emitting portion of the lighting device includes a plurality of light-emitting segments arranged in matrix and each including an EL layer between a pair of electrodes (an anode and a cathode). The area of a light-emitting region in each the light-emitting segment is varied as appropriate so as to obtain a desired light-emitting luminance from the light-emitting region; accordingly, gray-scale display can be performed and a still image can be displayed only by 1 external power source.

Accordingly, one embodiment of the present invention is a lighting device including a connection terminal and a light-emitting portion. The light-emitting portion includes a plurality of light-emitting segments arranged in matrix and each including an EL layer between a pair of electrodes (an anode and a cathode). The plurality of light-emitting segments includes light-emitting segments whose light-emitting regions are different in area.

Another embodiment of the present invention is a lighting device including a connection terminal and a light-emitting portion. The light-emitting portion includes a plurality of light-emitting segments arranged in matrix and each including an insulating film and an EL layer between a pair of electrodes (an anode and a cathode). The plurality of light-emitting segments includes light-emitting segments whose light-emitting regions are different in area by varying the shapes or the areas of a plurality of openings in the insulating film in positions overlapping with the EL layer.

In addition, another embodiment of the present invention is a lighting device including a connection terminal and a light-emitting portion. The light-emitting portion includes a plurality of light-emitting segments arranged in matrix and each including an insulating film and an EL layer between a pair of electrodes (an anode and a cathode). The pair of electrodes is separately formed in each of the light-emitting segments. An anode of a first light-emitting segment is electrically connected to a cathode of a second light-emitting segment. A cathode of the first light-emitting segment is electrically connected to an anode of a third light-emitting segment. The plurality of light-emitting segments includes light-emitting segments whose light-emitting regions are different in area Further, another embodiment of the present invention is a lighting device including a connection terminal and a light-emitting portion. The light-emitting portion includes a plurality of light-emitting segments arranged in matrix and each including an insulating film and an EL layer between a pair of electrodes (an anode and a cathode). The pair of electrodes is separately formed in each of the light-emitting segments. An anode of a first light-emitting segment is electrically connected to a cathode of a second light-emitting segment. A cathode of the first light-emitting segment is electrically connected to an anode of a third light-emitting segment. The plurality of light-emitting segments includes light-emitting segments whose light-emitting regions are different in area by varying the shapes or the areas of a plurality of openings in the insulating film in positions overlapping with the EL layer.

Further, another embodiment of the present invention is a lighting device including a connection terminal and a light-emitting portion. The light-emitting portion includes a plurality of light-emitting segments arranged in matrix and each including an insulating film and an EL layer between a pair of electrodes (an anode and a cathode). The plurality of light-emitting segments emits light; accordingly, an image, a design, a color, or a combination thereof is displayed on the light-emitting portion.

Further, another embodiment of the present invention is a lighting device including a connection terminal and a light-emitting portion. The light-emitting portion includes a plurality of light-emitting segments arranged in matrix and each including an insulating film and an EL layer between a pair of electrodes (an anode and a cathode). The plurality of light-emitting segments includes light-emitting segments whose light-emitting regions are different in area and color. The plurality of light-emitting segments emits light; accordingly, an image, a design, a color, or a combination thereof is displayed on the light-emitting portion.

In each of the above structures, a color filter may be provided in a position overlapping with the light-emitting region and a material exhibiting a white light emission may be used for the EL layer.

Further, in each of the above structures, the EL layer formed in the opening in the insulating film may be formed using a material exhibiting light emission of a color depending on the light-emitting segment.

In accordance with the lighting device of one embodiment of the present invention, a lighting device in which a desired display can be performed without an element such as a TFT in a light-emitting portion can be manufactured; thus, manufacturing process can be easy, yield is improved, and manufacturing cost can be reduced.

DETAILED DESCRIPTION OF THE INVENTION

Hereinafter, Embodiments of the present invention will be described with reference to the drawings. Note that the invention is not limited to the following description, and it will be easily understood by those skilled in the art that various changes and modifications can be made without departing from the spirit and scope of the present invention. Therefore, the present invention should not be construed as being limited to the description in the following embodiments.

Embodiment 1

In this embodiment, a structure of a lighting device which is one embodiment of the present invention will be described with reference to FIGS. 1A to 1C and FIG. 2.

Figure 1A:
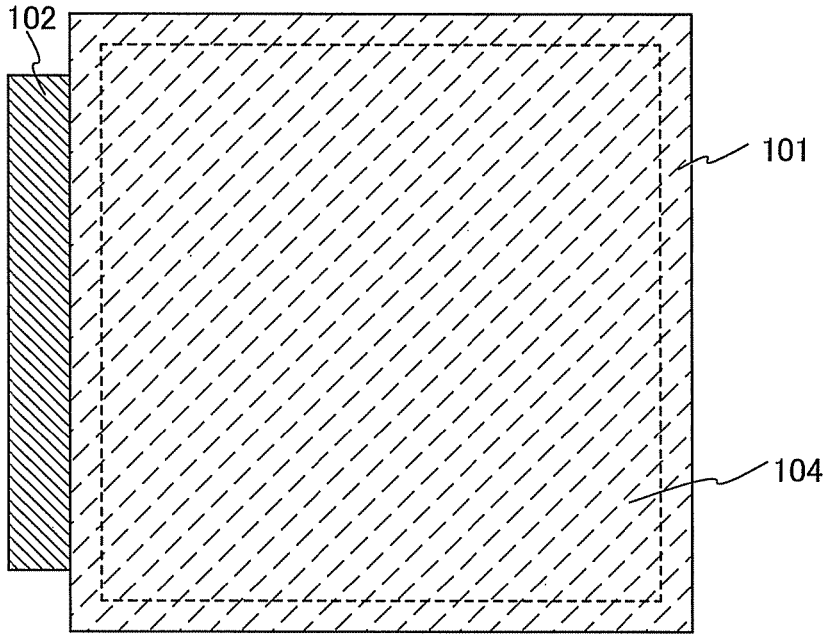
FIGS. 1A to 1C illustrate a lighting device of one embodiment of the present invention.

FIG. 1A illustrates a top view of a lighting device. A lighting device 101 includes a connection terminal 102 and a light-emitting portion 104. The light-emitting portion 104 includes a plurality of light-emitting segments each of which includes an EL layer between a first electrode and a second electrode (that is, an anode and a cathode). The plurality of light-emitting segments is arranged laterally and longitudinally in an ordered manner in a grid pattern (so-called in matrix).

The connection terminal 102 is a terminal for connecting the first and second electrodes of the light-emitting segment in the light-emitting portion 104 to an external power source. Note that the structure of the connection terminal is not limited to the structure in FIG. 1A and two or more terminals may be provided. In addition, "light-emitting segment" here corresponds to a pixel in a display.

Figure 1B:
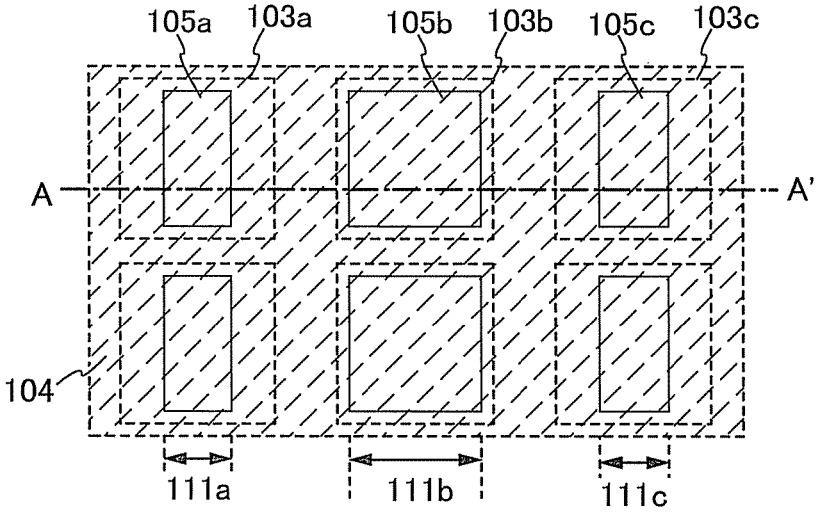

FIG. 1B illustrates part of the light-emitting portion 104 in FIG. 1A. FIG. 1B shows that the areas of light-emitting regions (105*a*, 105*b*, and 105*c*) included in light-emitting segments (103*a*, 103*b*, and 103*c*), respectively, which are arranged in matrix in the light-emitting portion 104, can be different from each other. Note that "light-emitting region" here means a region where light is emitted from one light-emitting segment.

Figure 1C:
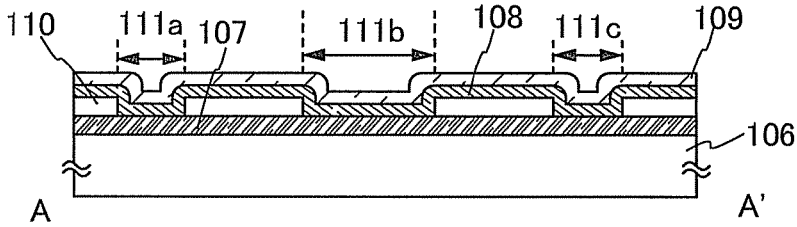

FIG. 1C illustrates a cross-sectional view taken along a dashed-dotted line A-A' of the top view of FIG. 1B. As illustrated in FIG. 1C, the light-emitting segment includes a first electrode 107, an EL layer 108, and a second electrode 109 which are stacked in this order over a substrate 106. The EL layer 108 is farmed over an insulating film 110 having a plurality of openings (111*a*, 111*b*, and 111*c*), over the first electrode 107. Since the first electrode 107, the EL layer 108, and the second electrode 109 are stacked and in contact with each other in each of the plurality of openings (111*a*, 111*b*, and 111*c*) provided in the insulating film 110, the shape of the light-emitting region of the light-emitting segment is determined according to the shape of its corresponding opening in the insulating film 110. Thus, in the lighting device of one embodiment of the present invention, the plurality of light-emitting segments is formed in matrix in the entire light-emitting portion 104, and the luminance of each light-emitting segment is determined according to the shape of its corresponding opening in the insulating film 110. In addition, a light-emitting segment can be controlled to emit no light by providing no opening in a corresponding portion.

Since each of the first electrode 107 and the second electrode 109 is formed of a continuous film as illustrated in FIG. 1C, the first electrodes 107 and the second electrodes 109 are each electrically continuous between different light-emitting segments. The EL layer 108 is also formed of a continuous film; however, the EL layer 108 is not in contact with the first electrode 107 in a portion where the insulating film 110 is formed, so that carriers are not injected from the first electrode 107. Thus, no light is emitted over the insulating film 110, that is, between adjacent light-emitting segments.

Note that a light-emitting segment is formed in each of the plurality of openings (111*a*, 111*b*, and 111*c*) in the insulating film 110, and the light-emitting regions (105*a*, 105*b*, and 105*c*) of the light-emitting segments are determined depending on the areas (including shapes) of the openings (111*a*, 111*b*, and 111*c*) in the insulating film 110. Thus, the areas (including shapes) of the openings (111*a*, 111*b*, and 111*c*) in the insulating film 110 are varied to form desired light-emitting regions in the respective light-emitting segments.

Figure 2:
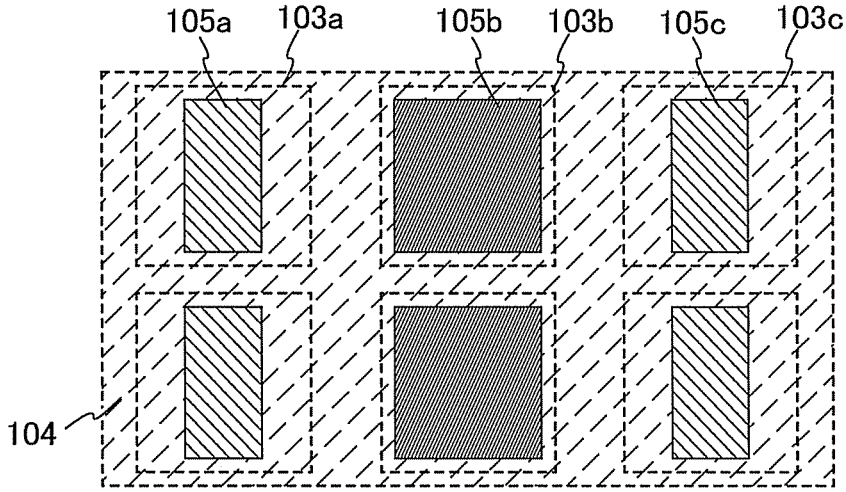
FIG. 2 illustrates a lighting device of one embodiment of the present invention.

When the areas of the light-emitting regions (105*a*, 105*b*, and 105*c*) in the light-emitting segments are varied, light-emitting luminance (cd/cm$^2$) can be varied from one light-emitting segment to another, like in the light-emitting portion 104 in FIG. 2.

Accordingly, when the plurality of light-emitting segments is arranged in matrix in the light-emitting portion 104 of the lighting device 101, the areas (including shapes) of the openings (111*a*, 111*b*, and 111*c*) in the insulating film 110 are varied to obtain desired light-emitting luminance from each of the light-emitting segments; thus, gray-scale display for displaying a desired still image can be performed in the light-emitting portion 104 of the lighting device 101. Note that the openings in the insulating film can be miniaturized by a conventional semiconductor process, and thus, a high-definition still image can be displayed.

A still image display can be changed by changing a pattern of the insulating film to change the area of the opening. The display image can be changed by a pattern change of only 1 layer, and thus, additional cost for changing the display image can be reduced. Note that a printing method such as screen printing is preferably used for forming the openings, in which case cost for changing the display image can be further reduced.

Embodiment 2

In this embodiment, a lighting device according to one embodiment of the present invention and a manufacturing method thereof will be described with reference to FIGS. 3A to 3C, FIGS. 4A to 4C, and FIGS. 5A to 5C.

Figure 3A:
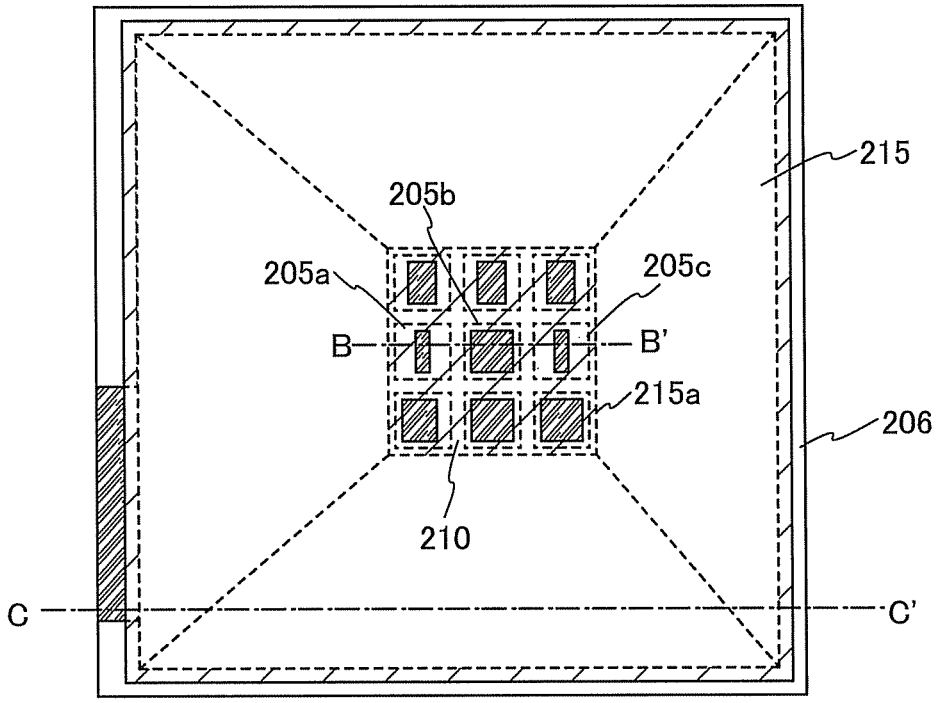
FIGS. 3A to 3C illustrate a manufacturing method of a lighting device of one embodiment of the present invention.
Figure 3B:
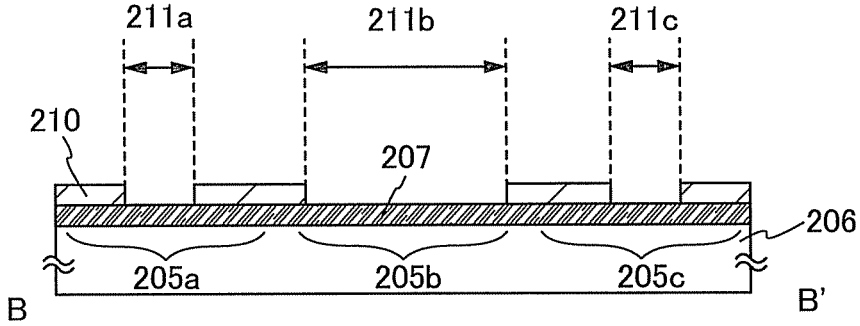
Figure 3C:
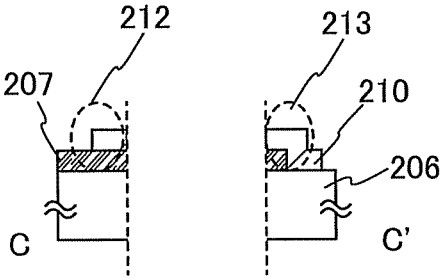

As illustrated in FIGS. 3A to 3C, a first electrode 207 is formed over a substrate 206.

For the substrate 206, for example, glass, quartz, plastic, or the like can be used. Furthermore, a flexible substrate may be used. The flexible substrate is a substrate that can be bent, such as a plastic substrate made of polycarbonate, polyarylate, or polyether sulfone, for example. Alternatively a film (made of polypropylene, polyester, polyvinyl fluoride, polyvinyl chloride, or the like), an inorganic film formed by evaporation, or the like can be used. Note that materials other than these can be used as long as they can function as a support in a manufacturing process of the light-emitting element.

As the first electrode 207 over the substrate 206, a metal, an alloy, an electrically conductive compound, a mixture thereof, and the like can be used. Specifically, indium tin oxide (ITO), indium tin oxide containing silicon or silicon oxide, indium zinc oxide, indium oxide containing tungsten oxide and zinc oxide, gold (Au), platinum (Pt), nickel (Ni), tungsten (W), chromium (Cr), molybdenum (Mo), iron (Fe), cobalt (Co), copper (Cu), palladium (Pd), and titanium (Ti) can be used. In addition, an element belonging to Group 1 or Group 2 of the periodic table, for example, an alkali metal such as lithium (Li) or cesium (Cs), an alkaline earth metal such as calcium (Ca) or strontium (Sr), magnesium (Mg), an alloy containing such an element (MgAg, AlLi), a rare earth metal such as europium (Eu) or ytterbium (Yb), an alloy containing such an element, and the like can be used.

Note that the first electrode 207 including any of these materials is usually formed by a sputtering method, but may be formed by a vacuum evaporation method, a CVD method, a coating method, an ink-jet method, a printing method, a spin coating method, or the like.

Next, an insulating film 210 is formed over the first electrode 207.

The insulating film 210 can be formed using an inorganic material such as an oxide of silicon or a nitride of silicon (e.g., silicon oxide, silicon nitride, silicon oxynitride, silicon nitride oxide, and the like); an organic material such as polyimide, polyamide, benzocyclobutene-based resin, acrylic resin, or epoxy resin; a siloxane material; or the like. The insulating film 210 can be formed to have a single-layer structure or a stacked-layer structure using any of these materials.

Note that the insulating film 210 formed using those materials can be formed by CVD, sputtering, SOG, droplet discharging, screen printing, or the like.

There is a plurality of openings with different areas in the insulating film 210. The plurality of openings can be formed by etching treatment using a mask. Note that either a wet etching or a dry etching is employed in the etching treatment. Alternatively, a printing method such as a screen printing can be employed, in which case the number of steps can be reduced.

FIG. 3B illustrates a cross-sectional view taken along a dashed-dotted line B-B' showing the light-emitting portion 215*a* which is a partial enlarged view of the light-emitting portion 215 in FIG. 3A. As illustrated in FIG. 3B, the areas of the light-emitting regions are different between the light-emitting segments (205*a*, 205*b*, and 205*c*) owing to the insulating film 210 having the openings. Note that in the cross-sectional view taken along the dashed-dotted line B-B' in FIG. 3B, the sizes of openings 211*a*, 211*b*, and 211*c* of the light-emitting segments (205*a*, 205*b*, and 205*c*) are different.

FIG. 3C illustrates a cross-sectional view taken along a dashed-dotted line C-C' in FIG. 3A. As illustrated in FIG. 3C, the first electrode 207 is partly exposed in a terminal portion 212 and is electrically connected to the outside via a connection terminal which is formed later. Note that the first electrode 207 is covered with the insulating film 210 in the terminal portion 213.

Figure 4A:
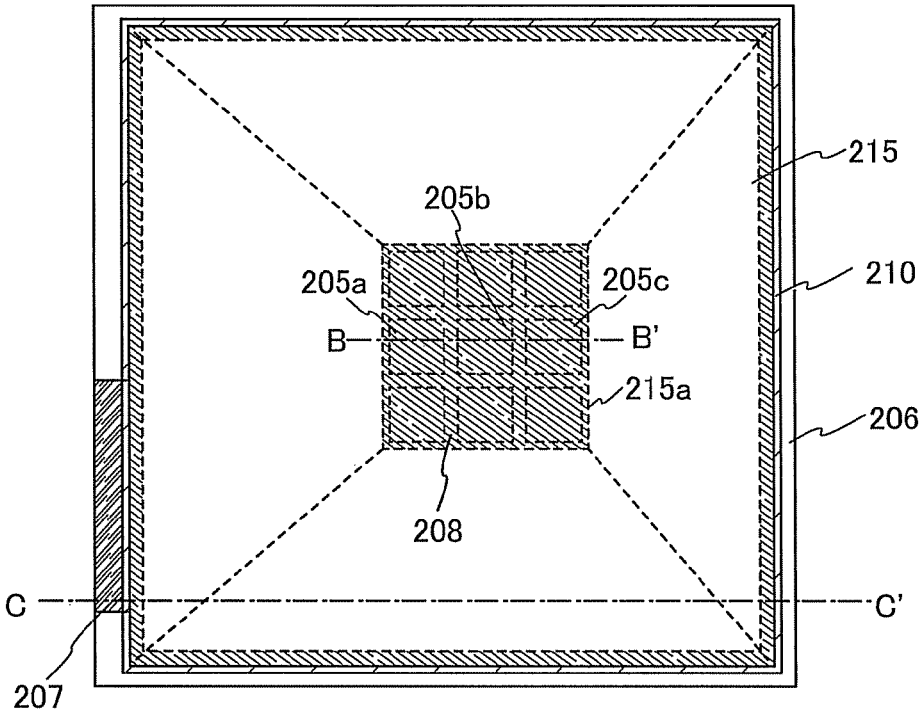
FIGS. 4A to 4C illustrate a manufacturing method of a lighting device of one embodiment of the present invention.
Figure 4B:
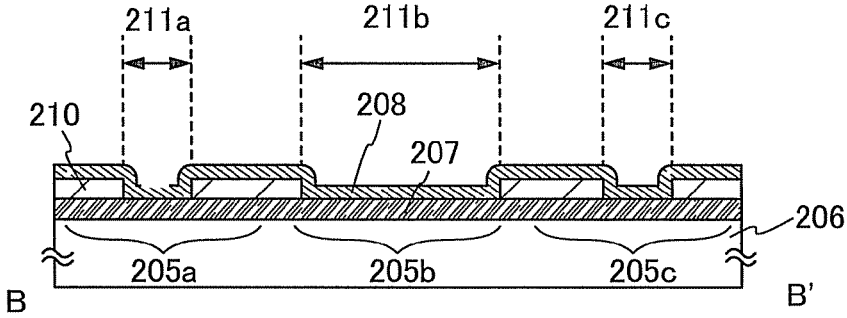
Figure 4C:
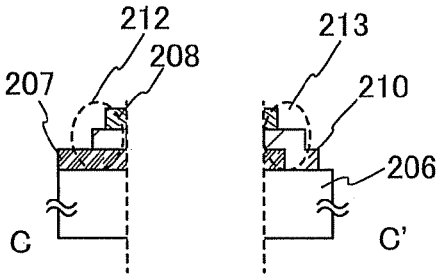

Next, as illustrated in FIGS. 4A to 4C, an EL layer 208 is formed. The EL layer 208 is formed over the first electrode 207 and the insulating film 210.

Note that a known substance can be used for the EL layer 208, and either low molecular compounds or high molecular compounds can be used. Note that the material for forming the EL layer 208 includes not only an organic compound but also an inorganic compound in part thereof.

The EL layer 208 can be formed by stacking, in an appropriate combination, a hole-injection layer containing a substance having a high hole-injection property, a hole-transport layer containing a substance having a high hole-transport property, a light-emitting layer containing a light-emitting substance, an electron-transport layer containing a substance having a high electron-transport property, an electron-injection layer containing a substance having a high electron-injection property, a charge-generation layer containing a substance which generates a charge, and the like.

In the case of forming a hole-injection layer, a substance having a high hole-injection property can be used. For example, molybdenum oxide, vanadium oxide, ruthenium oxide, tungsten oxide, manganese oxide, or the like can be used.

Alternatively, phthalocyanine-based compound such as phthalocyanine (abbreviation: $H_2Pc$) or copper phthalocyanine (abbreviation: CuPc), or a high molecule such as poly(3,4-ethylenedioxythiophene)/poly(styrenesulfonic acid) (PEDOT/PSS), or the like can be used.

In the case of forming a hole-transport layer, a substance having a high hole-transport property can be used. As a low molecular organic compound of a substance having a high hole-transport property, aromatic amine compounds such as NPB (or α-NPD), TPD, 4,4'-bis[N-(9,9-dimetylfluoren-2-yl)-N-phenylamino]biphenyl (abbreviation; DFLDPBi), and 4,4'-bis[N-(spiro-9,9'-bifluoren-2-yl)-N-phenylamino]biphenyl (abbreviation: BSPB) can be used. Further, a high molecular compound such as PVK, PVTPA, PTPDMA, or Poly-TPD can be also used. Note that these substances mentioned here are mainly substances that have a hole mobility of $10^{-6}$ $cm^2/Vs$ or higher, although other substances may also be used as long as the hole-transport property thereof is higher than the electron-transport property thereof. Note that the layer that includes the substance having a high hole-transport property is not limited to a single layer, but two or more layers that include the aforementioned substances may be stacked.

In the case of forming a light-emitting layer, a light-emitting substance is used. As the light-emitting substance, for example, a fluorescent compound, which emits fluorescence, or a phosphorescent compound, which emits phosphorescence, can be used.

As the fluorescent compound used for the light-emitting layer, the following can be used, for example: N,N'-bis[4-(9H-carbazol-9-yl)phenyl]-N,N'-diphenylstilbene-4,4'-diamine (abbreviation: YGA2S), 4-(9H-carbazol-9-yl)-4'-(10-phenyl-9-anthryl)triphenylamine (abbreviation: YGAPA), 4-(9H-carbazol-9-yl)-4'-(9,10-diphenyl-2-anthryl)triphenylamine (abbreviation: 2YGAPPA), N,9-diphenyl-N-[4-(10-phenyl-9-anthryl)phenyl]-9H-carbazol-3-amine (abbreviation: PCAPA), perylene, 2,5,8,11-tetra-tert-butylperylene (abbreviation: TBP), 4-(10-phenyl-9-anthryl)-4'-(9-phenyl-9H-carbazol-3-yl)triphenylamine (abbreviation: PCBAPA), N,N''-(2-tert-butylanthracene-9,10-diyldi-4,1-phenylene)bis[N,N',N'-triphenyl-1,4-phen ylenediamine](abbreviation: DPABPA), N,9-diphenyl-N-[4-(9,10-diphenyl-2-anthryl)phenyl]-9H-carbazol-3-amine (abbreviation: 2PCAPPA), N-[4-(9,10-diphenyl-2-anthryl)phenyl]-N,N',N''-triphenyl-1,4-phenylenediamine (abbreviation: 2DPAPPA), N,N,N',N',N'',N'',N''',N'''-octaphenyldibenzo[g,p]chrysene-2,7,10,15-tetraamine (abbreviation: DBC1), coumarin 30, N-(9,10-diphenyl-2-anthryl)-N,9-diphenyl-9H-carbazol-3-amine (abbreviation: 2PCAPA), N-[9,10-bis(1,1'-biphenyl-2-yl)-2-anthryl]-N,9-diphenyl-9H-carbazol-3-amine (abbreviation: 2PCABPhA), N-(9,10-diphenyl-2-anthryl)-N,N',N'-triphenyl-1,4-phenylenediamine (abbreviation: 2DPAPA), N-[9,10-bis(1,1'-biphenyl-2-yl)-2-anthryl]-N,N',N'-triphenyl-1,4-phenylenediamine (abbreviation: 2DPABPhA), 9,10-bis(1,1'-biphenyl-2-yl)-N-[4-(9H-carbazol-9-yl)phenyl]-N-phenylanthracen-2-amine (abbreviation: 2YGABPhA), N,N,9-triphenylanthracen-9-amine (abbreviation: DPhAPhA), coumarin 545T, N,N'-diphenylquinacridone (abbreviation: DPQd), rubrene, 5,12-bis(1,1'-biphenyl-4-yl)-6,11-diphenyltetracene (abbreviation: BPT), 2-(2-{2-[4-(dimethylamino)phenyl]ethenyl}-6-methyl-4H-pyran-4-ylidene)propanedinitrile (abbreviation: DCM1), 2-{2-methyl-6-[2-(2,3,6,7-tetrahydro-1H,5H-benzo[ij]quinolizin-9-yl)ethenyl]-4H-pyran-4-ylidene}propanedinitrile (abbreviation: DCM2), N,N,N',N'-tetrakis(4-methylphenyl)tetracene-5,11-diamine (abbreviation: p-mPhTD), 7,14-diphenyl-N,N,N',N'-tetrakis(4-methylphenyl)acenaphtho[1,2-a]fluoranthene-3,10-diamine (abbreviation: p-mPhAFD), 2-{2-isopropyl-6-[2-(1,1,7,7-tetramethyl-2,3,6,7-tetrahydro-1H,5H-benzo quinolizin-9-yl)ethenyl]-4H-pyran-4-ylidene}propanedinitrile (abbreviation: DCJTI), 2-{2-tert-butyl-6-[2-(1,1,7,7-tetramethyl-2,3,6,7-tetrahydro-1H,5H-benzo[ij]quinolizin-9-yl)ethenyl]-4H-pyran-4-ylidene}propanedinitrile (abbreviation: DCJTB), 2-(2,6-bis{2-[4-(dimethylamino)phenyl]ethenyl}-4H-pyran-4-ylidene)propanedinitrile (abbreviation: BisDCM), 2-{2,6-bis[2-(8-methoxy-1,1,7,7-tetramethyl-2,3,6,7-tetrahydro-1H,5H-benzo[ij]quinolizin-9-yl)ethenyl]-4H-pyran-4-ylidene}propanedinitrile (abbreviation: BisDCJTM), and the like:

As a phosphorescent compound which can be used for the light-emitting layer, the following can be given, for example: bis[2-(4',6'-difluorophenyl)pyridinato-N, $C^{2'}$]iridium(III) tetrakis(1-pyrazolyl)borate (abbreviation: FIr6), bis[2-(4',6'-difluorophenyppyridinato-N,$C^{2'}$]iridium(III)picolinate (abbreviation: FIrpic), bis[2-(3',5'-bistrifluoromethylphenyl)pyridinato-N,$C^{2'}$]iridium(III)picolinate (abbreviation: $Ir(CF_3ppy)_2(pic)$), bis[2-(4',6'-difluorophenyl)pyridinato-N,$C^{2'}$]iridium(III) acetylacetonate (abbreviation: FIracac), tris(2-phenylpyridinato)iridium(III) (abbreviation: $Ir(ppy)_3$), bis(2-phenylpyridinato)iridium(III)acetylacetonato (abbreviation: $Ir(ppy)_2(acac)$), bis(benzo[h]quinolinato)iridium(III)acetylacetonate (abbreviation: $Ir(bzq)_2(acac)$), bis(2,4-diphenyl-1,3-oxazolato-N,$C^{2'}$)iridium(III)acetylacetonate (abbreviation: $Ir(dpo)_2(acac)$), bis[2-(4'-perfluorophenylphenyl)pyridinato]iridium(III) acetylacetonate (abbreviation: $Ir(p\text{-}PF\text{-}ph)_2(acac)$), bis(2-phenylbenzothiazolato-N,$C^{2'}$)iridium(III)acetylacetonate (abbreviation: $Ir(bt)_2(acac)$), bis[2-(2'-benzo[4,5-α]thienyl)pyridinato-N,$C^{3'}$]iridium(III) acetylacetonate (abbreviation: $Ir(btp)_2(acac)$), bis(1-phenylisoquinolinato-N,$C^{2'}$)iridium(III)acetylacetonate (abbreviation: $Ir(piq)_2(acac)$), (acetylacetonato)bis[2,3-bis(4-fluorophenyl)quinoxalinato]iridium(III) (abbreviation: $Ir(Fdpq)_2(acac)$), (acetylacetonato)bis(2,3,5-triphenylpyrazinato)iridium(III) (abbreviation: $Ir(tppr)_2(acac)$), 2,3,7,8,12,13,17,18-octaethyl-21H,23H-porphyrin platinum(II) (abbreviation: PtOEP), tris(acetylacetonato)(monophenanthroline)terbium(III) (abbreviation: $Tb(acac)_3(Phen)$), tris(1,3-diphenyl-1,3-propanedionato)(monophenanthroline)europium(III) (abbreviation: $Eu(DBM)_3(Phen)$), tris[1-(2-thenoyl)-3,3,3-trifluoroacetonato](monophenanthroline)europium(III) (abbreviation: $Eu(TTA)_3(Phen)$), and the like.

Note that those light-emitting substances are preferably dispersed in a host material. As the host material, for example, the following can be used: an aromatic amine compound such as NPB (abbreviation), TPD (abbreviation), TCTA (abbreviation), TDATA (abbreviation), MTDATA (abbreviation), or BSPB (abbreviation); a carbazole derivative such as PCzPCA1 (abbreviation), PCzPCA2 (abbreviation), PCzPCN1 (abbreviation), CBP (abbreviation), TCPB (abbreviation), or CzPA (abbreviation); a substance having a high hole-transport property which contains a high molecular compound, such as PVK (abbreviation), PVTPA (abbreviation), PTPDMA (abbreviation), or Poly-TPD (abbreviation); a metal complex having a quinoline skeleton or a benzoquinoline skeleton, such as tris(8-quinolinolato)aluminum (abbreviation: Alq), tris(4-methyl-8-quinolinolato)aluminum (abbreviation: $Almq_3$), bis(10-hydroxybenzo[h]-quinolinato)beryllium (abbreviation: $BeBq_2$), or bis(2-methyl-8-quinolinolato)(4-phenylphenolato)aluminum (abbreviation: BAlq); a metal complex having an oxazole-based or thiazole-based ligand, such as bis[2-(2-hydroxyphenyl)benzoxazolato]zinc (abbreviation: $Zn(BOX)_2$) or bis[2-(2-hydroxyphenyl)-benzothiazolato]zinc (abbreviation: $Zn(BTZ)_2$); a substance having a high electron-transport property, such as 2-(4-biphenylyl)-5-(4-tert-butylphenyl)-1,3,4-oxadiazole (abbreviation: PBD), 1,3-bis[5-(p-tert-butylphenyl)-1,3,4-oxadiazol-2-yl]benzene (abbreviation: OXD-7), 9-[4-(5-phenyl-1,3,4-oxadiazol-2-yl)phenyl]carbazole (abbreviation: CO11), 3-(4-biphenylyl)-4-phenyl-5-(4-tert-butylphenyl)-1,2,4-triazole (abbreviation: TAZ), bathophenanthroline (abbreviation: BPhen), or bathocuproine (abbreviation: BCP); and the like.

In the case of forming an electron-transport layer, a substance having a high electron-transport property is used. As the high hole-transport substance, for example, a metal complex having a quinoline skeleton or a benzoquinoline skeleton, such as Alq (abbreviation), $Almq_3$ (abbreviation), $BeBq_2$ (abbreviation), or BAlq (abbreviation) can be used. In addition to the above, a metal complex having an oxazole-based or thiazole-based ligand, such as $Zn(BOX)_2$ (abbreviation) or $Zn(BTZ)_2$ (abbreviation) can also be used. Furthermore, in addition to the above metal complexes, PBD (abbreviation), OXD-7 (abbreviation), CO11 (abbreviation), TAZ (abbreviation), BPhen (abbreviation), BCP (abbreviation), or the like can also be used. The substances mentioned here are mainly ones that have an electron mobility of $10^{-6}$ $cm^2/Vs$ or higher. Note that substances other than those may be used as long as they have an electron-transport property higher than a hole-transport property. Furthermore, the electron-transport layer is not limited to a single layer, and two or more layers made of the above-described substances may be stacked.

In addition to the above substances, a high molecular compound such as PF-Py (abbreviation) or PF-BPy (abbreviation) can be used for the electron-transport layer.

In the case of forming an electron-injection layer, a substance having a high electron-injection property is used.

Examples of the substance having a high electron-injection property include an alkali metal, an alkaline earth metal, and a compound of these metals, such as lithium fluoride (LiF), cesium fluoride (CsF), or calcium fluoride ($CaF_2$). Alternatively, a layer containing a substance having an electron-transport property and an alkali metal, an alkaline earth metal, magnesium (Mg), or a compound thereof (e.g., Alq containing magnesium (Mg)) can be used.

A substance for generating a charge is used for forming a charge-generation layer. A charge-generation layer specifically means a layer containing a substance having a high hole-transport property and an acceptor substance. An electron is extracted from a substance having a high hole-transport property by an acceptor substance, so that a charge is generated.

As the substance having a high hole-transport property which can be used for the charge-generation layer, the following can be given, for example: aromatic amine compounds such as 4,4'-bis[N-(1-naphthyl)-N-phenylamino]biphenyl (abbreviation: NPB or α-NPD), N,N'-bis(3-methylphenyl)-N,N'-diphenyl[1,1'-biphenyl]-4,4'-diamine (abbreviation: TPD), 4,4',4"-tris(carbazol-9-yl)triphenylamine (abbreviation: TCTA), 4,4',4"-tris(N,N-diphenylamino)triphenylamine (abbreviation: TDATA), 4,4',4"-tris[N-(3-methylphenyl)-N-phenylamino]triphenylamine (abbreviation: MTDATA), and 4,4'-bis[N-(spiro-9,9'-bifluoren-2-yl)-N-phenylamino]biphenyl (abbreviation: BSPB); 3-[N-(9-phenylcarbazol-3-yl)-N-phenylamino]-9-phenylcarbazole (abbreviation: PCzPCA1); 3,6-bis[N-(9-phenylcarbazol-3-yl)-N-phenylamino]-9-phenylcarbazole (abbreviation: PCzPCA2); 3-[N-(1-naphthyl)-N-(9-phenylcarbazol-3-yl)amino]-9-phenylcarbazole (abbreviation: PCzPCN1); and the like. In addition, the following carbazole derivatives and the like can be used: 4,4'-di(N-carbazolyl)biphenyl (abbreviation: CBP), 1,3,5-tris[4-(N-carbazolyl)phenyl]benzene (abbreviation: TCPB), and 9-[4-(10-phenyl-9-anthracenyl)phenyl]-9H-carbazole (abbreviation: CzPA).

Further, a high molecular compound such as poly(N-vinylcarbazole) (abbreviation: PVK), poly(4-vinyltriphenylamine) (abbreviation: PVTPA), poly[N-(4-{N'-[4-(4-diphenylamino)phenyl]phenyl-N'-phenylamino}phenyl) methacrylamide](abbreviation: PTPDMA), or poly[N,N'-bis(4-butylphenyl)-N,N'-bis(phenyl)benzidine](abbreviation: Poly-TPD) can be used.

As examples of the acceptor substance that is used for the charge-generation layer, a transition metal oxide and an oxide of a metal belonging to any of Groups 4 to 8 of the periodic table can be given. Specifically, molybdenum oxide is particularly preferable.

Note that the layers (the hole-injection layer, the hole-transport layer, the light-emitting layer, the electron-transport layer, the electron-injection layer, and a charge-generation layer) included in the EL layer 208 can be formed by an evaporation method (including a vacuum evaporation method), an ink-jet method, a coating method, or the like. Note that a different formation method may be employed for each layer.

Note that color of light emitted from the EL layer 208 can be changed by changing the kind of a light-emitting substance used for the EL layer 208. Further, color of light emitted from the EL layer 208 can be changed by using plural kinds of light-emitting substance. Accordingly, desired light-emission colors such as red, green, blue, yellow, orange, white, and the like can be obtained.

FIG. 4B illustrates a cross-sectional view taken along a dashed-dotted line B-B' showing the light-emitting portion 215*a* which is a partial enlarged view of the light-emitting portion 215 in FIG. 4A. The EL layer 208 may be formed with a single film as illustrated in FIG. 4B. Alternatively, the EL layer 208 may be formed separately using a corresponding material for each of the light-emitting segments (205*a*, 205*b*, and 205*c*).

FIG. 4C illustrates a cross-sectional view taken along a dashed-dotted line C-C' in FIG. 4A. As illustrated in FIG. 4C, the EL layer 208 is stacked over the insulating film 210 in the terminal portion 212 and the terminal portion 213.

Figure 5A:
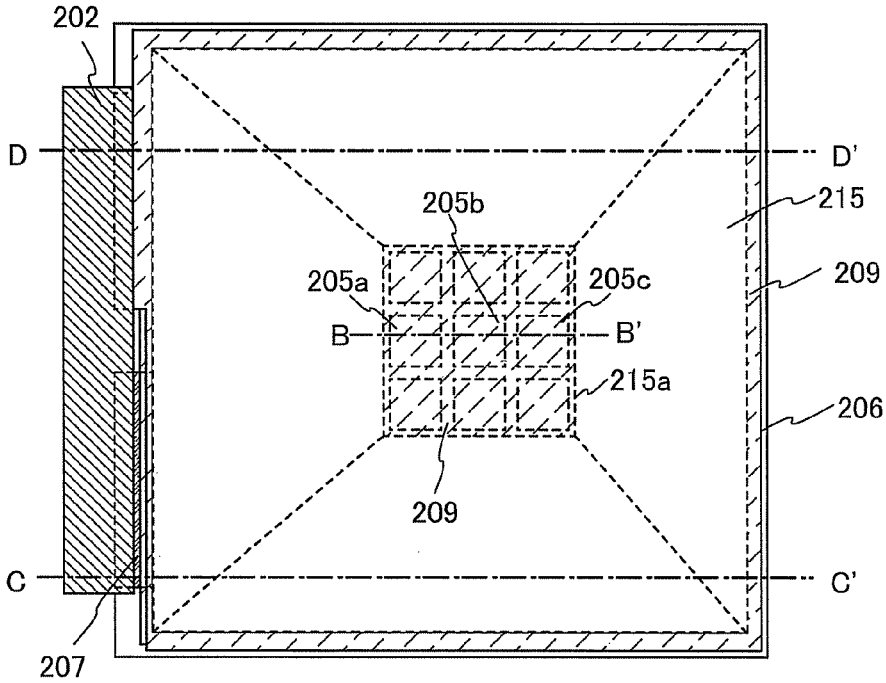
FIGS. 5A to 5D illustrate a manufacturing method of a lighting device of one embodiment of the present invention.
Figure 5B:
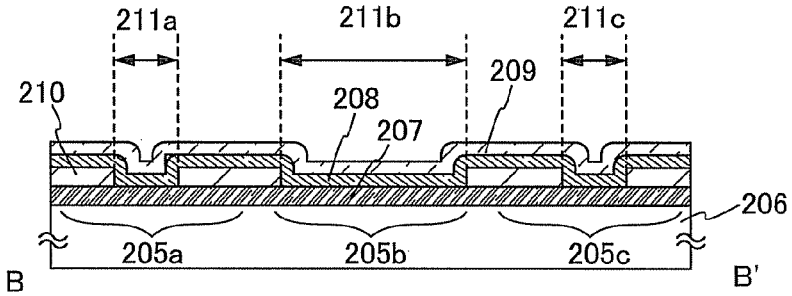
Figure 5C:
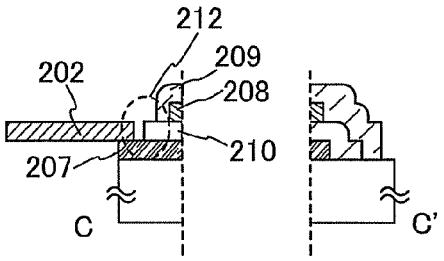

Next, a second electrode 209 is formed as illustrated in FIGS. 5A to 5C. The second electrode 209 can be formed using a method and a material similar to those for the first electrode 207.

FIG. 5B illustrates a cross-sectional view taken along a dashed-dotted line B-B' showing the light-emitting portion 215*a* which is a partial enlarged view of the light-emitting portion 215 in FIG. 5A. As illustrated in FIG. 5B, the second electrode 209 is formed of a single film.

Figure 5D:
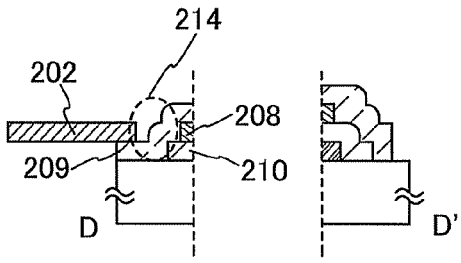

FIG. 5C illustrates a cross-sectional view taken along a dashed-dotted line C-C' in FIG. 5A. As illustrated in FIG. 5C, a connection terminal 202 is provided so as to be in contact with the first electrode 207 in the terminal portion 212. Further, FIG. 5D illustrates a cross-sectional view taken along a dashed-dotted line D-D' in FIG. 5A. As illustrated in FIG. 5D, the connection terminal 202 is provided so as to be in contact with the second electrode 209 in a terminal portion 214. Note that each of the first electrode 207 and the second electrode 209 is electrically connected to an external power source by the connection terminal 202.

Note that in the lighting device described in this embodiment, light emission from the plurality of light-emitting segments arranged in matrix in the light-emitting portion 215 may be obtained from the first electrode 207 side, from the second electrode 209 side, or from both sides. Note that an electrode material having a light-transmitting property needs to be used at least for an electrode on the side from which light-emission is obtained.

Through the above process, the lighting device of one embodiment of the present invention can be manufactured; however, the present invention is not limited to the structure described in this embodiment.

Embodiment 3

In this embodiment, as a specific example of a lighting device of one embodiment of the present invention, a structure of a lighting device displaying a full-color image in which an EL layer included in a light-emitting segment is formed using a material emitting white light and is combined with a color filter, will be described with reference to FIGS. 6A and 6B. Note that in the structure of FIGS. 6A and 6B, light from the EL layer is emitted in the direction indicated by an arrow in FIG. 6A (shown in the above in the figure).

Figure 6A:
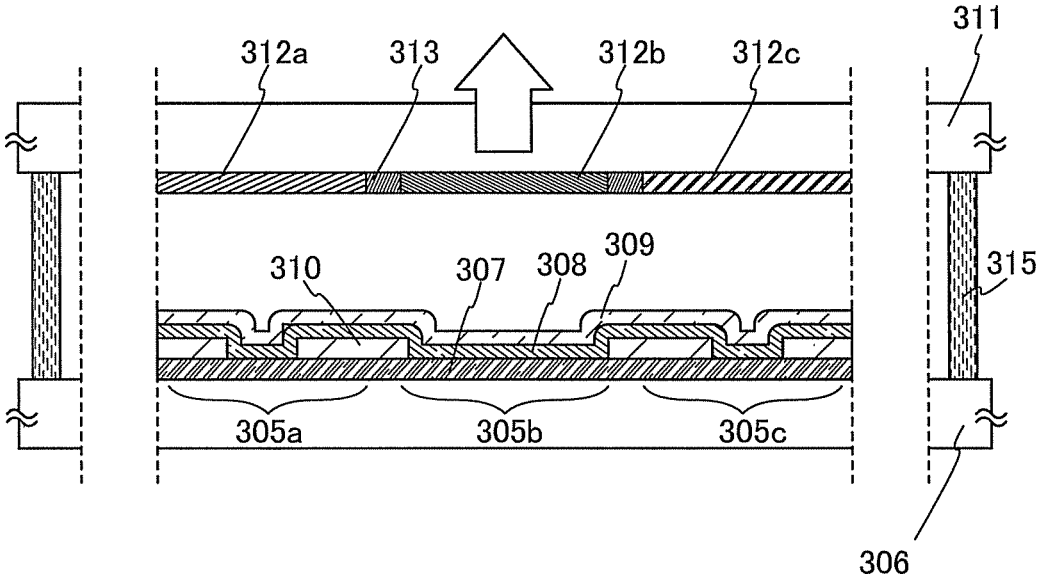
FIGS. 6A and 6B illustrate a lighting device of one embodiment of the present invention.
Figure 6B:
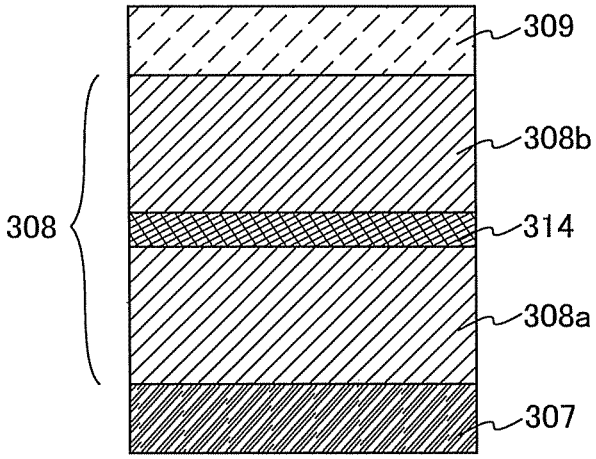

In FIG. 6A, a first electrode 307 is formed over a first substrate 306, and an EL layer 308 is formed over the first electrode 307 and an insulating film 310. Further, color filters (312*a*, 312*b*, and 312*c*) which have the same size in accordance with the shapes of the light-emitting segments are formed. Accordingly, the same color filters can be used even when an image displayed by the lighting device is changed.

Note that for the EL layer 308 in this embodiment, a plurality of kinds of light-emitting substances may be appropriately selected and mixed to emit white light. Specifically, the light-emitting substance described in Embodiment 2 can be used as the light-emitting substance.

Alternatively, layers containing different light-emitting substances may be stacked to obtain white light. As for the combination of a plurality of light-emitting layers, specifically, a structure for emitting white light by including red light, green light, and blue light may be used. For example, the structure may include a stack of a first layer containing a blue fluorescent material as a light-emitting substance and a second layer containing red and green phosphorescent materials as light-emitting substances. Alternatively, the structure may include a stack of a first layer exhibiting red light emission, a second layer exhibiting green light emission, and a third layer exhibiting blue light emission. Further alternatively, with a structure including a stack of light-emitting layers emitting light of complementary colors, a white light emission can be obtained. In the case of stacking layers emitting light of complementary colors, a stack of a layer exhibiting blue light emission and a layer exhibiting yellow light emission, or a stack of a layer exhibiting blue-green light emission and a layer exhibiting red light emission or the like can be given.

In the case of stacking layers emitting different colors of light as described above, a structure in FIG. 6B can be employed. That is, a charge generation layer 314 may be provided between light-emission layers (308*a* and 308*b*) emitting different colors of light in the EL layer 308 between the first electrode 307 and the second electrode 309.

Note that in this case, the charge generation layer 314 may have either a structure in which an acceptor substance is added to a substance having a high hole-transport property or a structure in which a substance having a donor property is added to a substance having a high electron-transport property. Alternatively, both of these structures may be stacked.

In the case of the structure in which an acceptor substance is added to a substance having a high hole-transport property, examples of the substances having a high hole-transport property include aromatic amine compounds such as 4,4'-bis[N-(1-naphthyl)-N-phenylamino]biphenyl (abbreviation: NPB or α-NPD), N,N'-bis(3-methylphenyl)-N,N'-diphenyl-[1,1'-biphenyl]-4,4'-diamine (abbreviation: TPD), 4,4',4"-tris(N,N-diphenylamino)triphenylamine (abbreviation: TDATA), 4,4',4"-tris[N-(3-methylphenyl)-N-phenylamino]triphenylamine (abbreviation: MTDATA), and 4,4'-bis[N-(spiro-9,9'-bifluoren-2-yl)-N-phenylamino]biphenyl (abbreviation: BSPB), and the like. The substances mentioned here are mainly substances that have a hole mobility of $10^{-6}$ $cm^2/Vs$ or higher. However, any substance other than the above substances may be used as long as it is a substance in which the hole-transport property is higher than the electron-transport property.

In addition, examples of the acceptor substance include 7,7,8,8-tetracyano-2,3,5,6-tetrafluoroquinodimethane (abbreviation: $F_4$-TCNQ) and chloranil and transition metal oxides. In addition, an oxide of metals that belong to Group 4 to Group 8 of the periodic table can be given. Specifically, vanadium oxide, niobium oxide, tantalum oxide, chromium oxide, molybdenum oxide, tungsten oxide, manganese oxide, and rhenium oxide are preferable since their electron-accepting property is high. Among these, molybdenum oxide is especially preferable since it is stable in the air and its hygroscopic property is low and is easily treated.

On the other hand, in the case of the structure in which a donor substance is added to a substance having a high electron-transport property, as the substance having a high electron-transport property, a metal complex having a quinoline skeleton or a benzoquinoline skeleton, such as tris(8-quinolinolato)aluminum (abbreviation: Alq), tris(4-methyl-8-quinolinolato)aluminum (abbreviation: $Almq_3$), bis(10-hydroxybenzo[h]-quinolinato)beryllium (abbreviation: $BeBq_2$), or bis(2-methyl-8-quinolinolato)(4-phenylphenolato)aluminum (abbreviation: BAlq), or the like can be used. Alternatively, a metal complex having an oxazole-based or thiazole-based ligand, such as bis[2-(2-hydroxyphenyl)benzoxazolato]zinc (abbreviation: $Zn(BOX)_2$) or bis[2-(2-hydroxyphenyl)benzothiazolato]zinc (abbreviation: $Zn(BTZ)_2$), or the like can be used. Besides the metal complexes, 2-(4-biphenylyl)-5-(4-tert-butylphenyl)-1,3,4-oxadiazole (abbreviation: PBD), 1,3-bis[5-(p-tert-butylphenyl)-1,3,4-oxadiazol-2-yl]benzene (abbreviation: OXD-7), 3-(4-biphenylyl)-4-phenyl-5-(4-tert-butylphenyl)-1,2,4-triazole (abbreviation: TAZ), bathophenanthroline (abbreviation: BPhen), bathocuproine (abbreviation: BCP), or the like can also be used. The substances mentioned here are mainly substances that have an electron mobility of $10^{-6}$ $cm^2/Vs$ or higher. Note that any substance other than the above substances may be used as long as it is a substance in which the electron-transport property is higher than the hole-transport property.

Further, for the donor substance, an alkali metal, an alkaline earth metal, a rare earth metal, a metal belonging to Group 2 and Group 13 of the periodic table, or oxide or carbonate thereof can be used. Specifically, lithium (Li), cesium (Cs), magnesium (Mg), calcium (Ca), ytterbium (Yb), indium (In), lithium oxide, cesium carbonate, or the like is preferably used. Alternatively, an organic compound such as tetrathianaphthacene may be used as the donor substance.

By providing the charge generation layer 314, the element can emits light with high luminance while keeping the current density low; accordingly, the element can have long lifetime. In addition, voltage drop due to resistance of the electrode material can be suppressed.

In addition, the first substrate 306 is bonded to the second substrate 311 with the sealant 315. The color filters (312*a*, 312*b*, and 312*c*) are formed to obtain desired light-emission colors in positions overlapping with light-emitting segments (305*a*, 305*b*, and 305*c*) over the second substrate 311, respectively. Note that as the color filters (312*a*, 312*b*, and 312*c*), for example, a red (R) color filter, a green (G) color filter, a blue (B) color filter, or the like can be used. Each color filter can be formed in a desired position with a known material by a printing method, an inkjet method, an etching method using a photolithography technique, or the like. In addition, black matrixes (BM) 313 are formed between the color filters 312*a* and 312*b* and between the color filters 312*b* and 312*c*.

Note that the material similar to that for the first substrate 306 can be used as a material for the second substrate 311.

Through the above process, a lighting device with a structure of displaying a full-color image can be manufactured. Note that the lighting device described in this embodiment can realize full color display without forming EL layers emitting light of different colors, and thus, manufacturing process can be easy and yield can be improved.

Note that the structure described in this embodiment can be combined as appropriate with any structure described in the other embodiments.

Embodiment 4

In this embodiment, as a specific example of a lighting device of one embodiment of the present invention, the following structure will be described with reference to FIGS. 7A and 7B: a light-emitting segment including a first electrodes 407*a*, an EL layer 408*a*, a second electrode 409*a*, a light-emitting segment including a first electrodes 407*b*, an EL layer 408*b*, a second electrode 409*b*, and a light-emitting segment including a first electrodes 407*c*, an EL layer 408*c*, a second electrode 409*c*, are formed; and the EL layers (408*a*, 408*b*, and 408*c*) emit different colors of light.

Figure 7A:
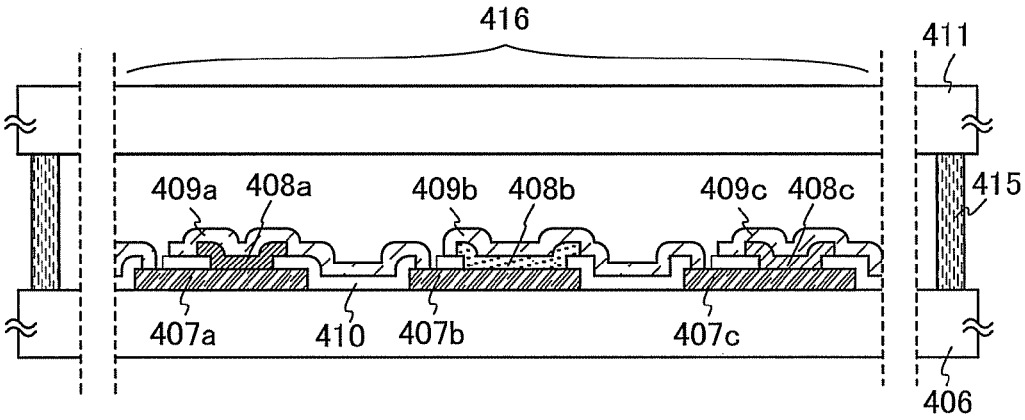
FIGS. 7A and 7B illustrate a lighting device of one embodiment of the present invention.

In FIG. 7A, the first electrodes (407*a*, 407*b*, and 407*c*) are formed separately from each other over a first substrate 406, and insulating films 410 are formed between the first electrodes. Note that in FIGS. 7A and 7B of this embodiment, the sizes of areas of the first electrodes (407*a*, 407*b*, and 407*c*) are the same, and a light-emitting region of each of the light-emitting segments is determined depending on the size of an opening in an insulating film formed over the corresponding first electrode (407*a*, 407*b*, or 407*c*). However, the present invention is not limited thereto, and the light-emitting region of each of the light-emitting segments may be changed by changing the size of area of the first electrode (407*a*, 407*b*, or 407*c*).

Note that the first electrodes (407*a*, 407*b*, and 407*c*) can be formed by using a method and a material similar to those described in Embodiment 2. Further, the first electrodes (407*a*, 407*b*, and 407*c*) may be separated by etching treatment with the use of a mask formed in a photolithography step.

The EL layers (408*a*, 408*b*, and 408*c*) formed separately over the first electrodes (407*a*, 407*b*, and 407*c*) may be formed using appropriate materials to emit different colors of light. Note that the EL layers (408*a*, 408*b*, and 408*c*) can be formed by using a method and a material similar to those described in Embodiment 2.

Figure 7B:
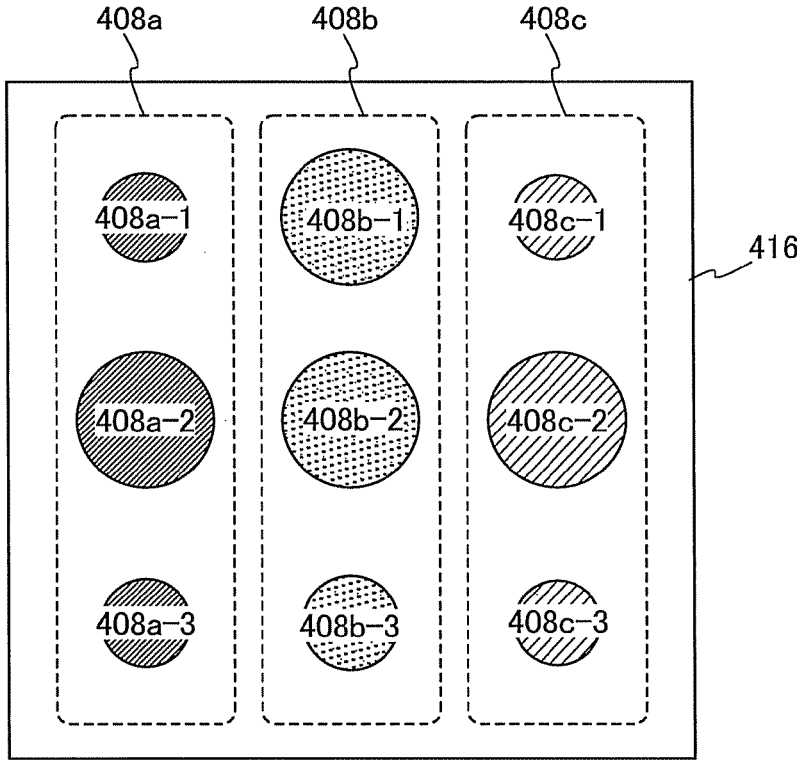

Note that the EL layers (408*a*, 408*b*, and 408*c*) may have a structure illustrated in FIG. 7B.

FIG. 7B is a top view of part of a light-emitting portion 416 in FIG. 7A. In FIG. 7B, EL layers (408*a*-1 to 408*a*-3, 408*b*-1 to 408*b*-3, and 408*c*-1 to 408*c*-3) have different areas in accordance with the area of a light-emitting region of each of the light-emitting segments. The EL layers in FIG. 7B have circular shapes, which is suitable when the EL layers are formed not only by an evaporation method, but also by an ink-jet method, or the like.

The second electrodes (409*a*, 409*b*, and 409*c*) are formed separately from each other over the EL layers (408*a*, 408*b*, and 408*c*), respectively. Each of the second electrodes (409*a*, 409*b*, and 409*c*) is electrically connected to a first electrode of one of the adjacent light-emitting segments. Accordingly, in the lighting device of this embodiment, the plurality of light-emitting segments formed in the light-emitting portion is all electrically connected to each other. Note that all the light-emitting segments may be connected in series or a structure in which light-emitting segments connected in parallel and light-emitting segments connected in series are combined may be employed.

A second substrate 411 is bonded to the first substrate 406 over which the plurality of light-emitting segments is formed, with the sealant 415. Note that the material described in Embodiment 3 can be used for the second substrate 411.

In the structure of this embodiment, the EL layers of the light-emitting segments are formed separately; thus, even when one light-emitting segment is short circuited, the other light-emitting segments are not influenced and can emit light.

Note that the structure described in this embodiment can be combined as appropriate with any of the structures described in the other embodiments.

Embodiment 5

Figure 8A:
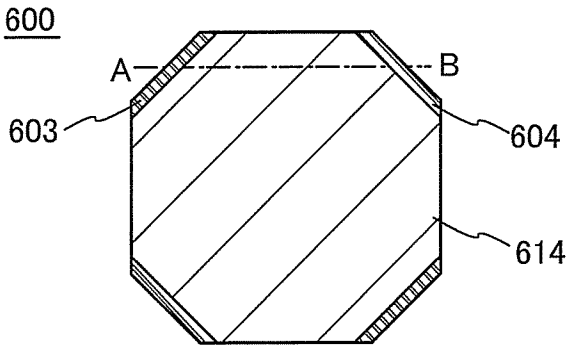
FIGS. 8A and 8B illustrate a lighting device of one embodiment of the present invention.

In this embodiment, a lighting device which is one embodiment of the present invention will be described with reference to FIGS. 8A and 8B. FIG. 8A is a top view illustrating a lighting device 600, and FIG. 8B is a cross-sectional view taken along line A-B of FIG. 8A.

The lighting device 600 illustrated in FIG. 8A has a structure in which a plurality of light-emitting segments is formed in matrix in a light-emitting portion 614 and one electrode of the light-emitting segment is electrically connected to a first terminal 603 and the other electrode of the light-emitting segment is electrically connected to a second terminal 604.

Figure 8B:
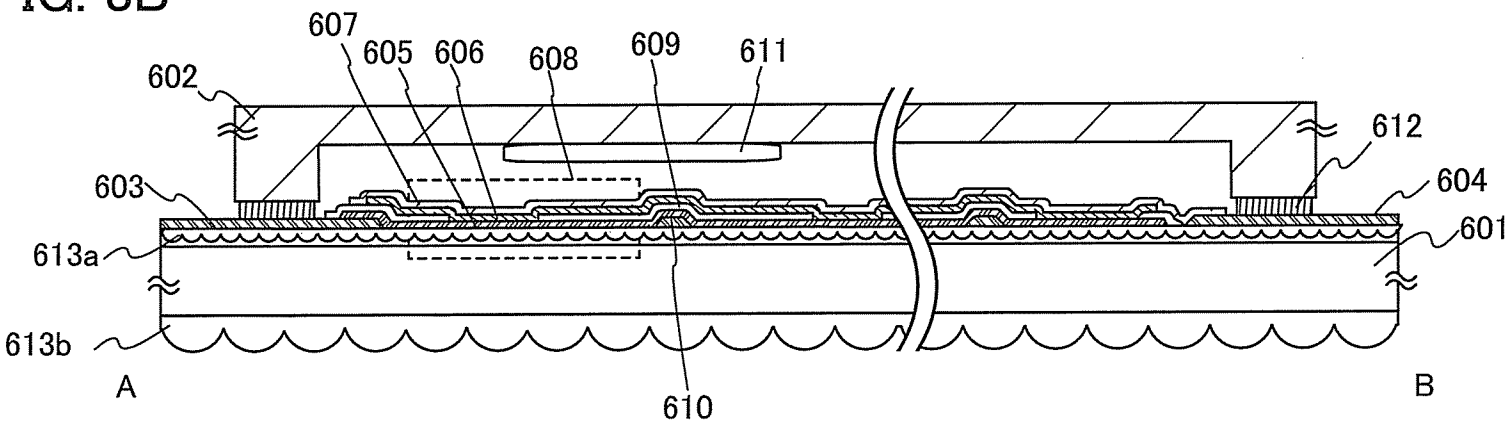

The lighting device 600 illustrated in FIG. 8B includes, over a first substrate 601, a light-emitting segment 608 including a first electrode 605, an EL layer 606, and a second electrode 607.

As illustrated in FIG. 8B, the first terminal 603 is electrically connected to an auxiliary wiring 610 and the first electrode 605. The second terminal 604 is electrically connected to the second electrode 607. An insulating layer 609 is formed over an edge portion of the first electrode 605 and the first electrode 605 in a region where the auxiliary wiring 610 is stacked. Note that although the first electrode 605 is formed over the auxiliary wiring 610 in FIG. 8B, the auxiliary wiring 610 may be formed over the first electrode 605.

The first substrate 601 and a second substrate 602 are bonded to each other with a sealant 612. A desiccant agent 611 is provided between the first substrate 601 and the second substrate 602.

A light extraction structure 613*a* with minute unevenness is provided between the light-emitting segment with a high refractive index and the substrate with a lower refractive index, and a light extraction structure 613*b* with unevenness larger than that of the light extraction structure 613*a* is provided between the first substrate 601 and the air. Such a light extraction structure may be provided at a top portion of the first substrate 601, a bottom portion of the first substrate 601, or both thereof.

The lighting device illustrated in FIG. 8B has a so-called bottom emission structure in which light emitted from the light-emitting segment 608 is extracted from the first electrode 605 side of the light-emitting segment 608; however, the present invention is not limited thereto, and a lighting device having a top emission structure in which light is extracted from the second electrode 607 side of the light-emitting segment 608 is also possible.

Although the lighting device 600 illustrated in FIG. 8A has an octagonal shape, one embodiment of the present invention is not limited thereto. The lighting device 600 may have other polygonal shapes or a shape with a curve. In particular, as the shape of the lighting device 600, a triangular shape, a rectangular shape, a hexagonal shape, or the like is preferable. This is because a plurality of the lighting devices 600 can be provided without a redundant space in a limited area.

Through the above, the lighting device of one embodiment of the present invention can be provided. Note that in the lighting device of one embodiment of the present invention, a desired display can be performed without an element such as a TFT in a light-emitting portion; thus, manufacturing process can be easy, yield is improved, and manufacturing cost can be reduced.

Note that the structure described in this embodiment can be combined as appropriate with any of the structures described in the other embodiments.

Embodiment 6

In this embodiment, a modified example of a lighting device of one embodiment of the present invention will be described with reference to FIG. 9.

Note that a lighting device of this embodiment can be manufactured using the lighting device described in any of Embodiment 1 to 5.

Figure 9:
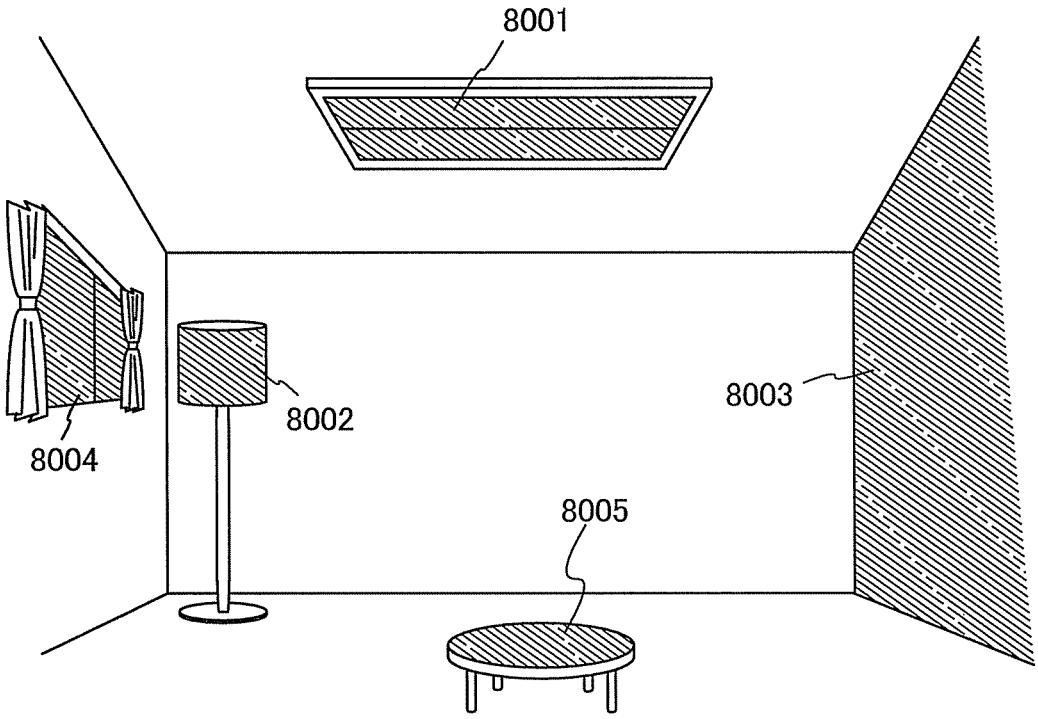
FIG. 9 illustrates a lighting device of one embodiment of the present invention.

FIG. 9 illustrates an example in which the lighting device according to one embodiment of the present invention is used as an indoor lighting device 8001. Since the lighting device can have a larger area, it can be used as a lighting device having a large area. In addition, a lighting device 8002 in which a light-emitting region has a curved surface can also be obtained with the use of a housing with a curved surface. A light-emitting element included in the lighting device described in this embodiment is in a thin film form, which allows the housing to be designed more freely. Accordingly, various elaborately-designed lighting devices can be obtained. Further, a wall of the room may be provided with a large-sized lighting device 8003.

The lighting device according to one embodiment of the present invention can also be used as a window glass 8004 by forming the lighting device with the use of only a light-transmitting material.

The lighting device according to one embodiment of the present invention can also be used as a table by using the light-emitting device as a surface of a table 8005. By using the light-emitting device as part of other furniture, the lighting device can be used as the furniture.

Through the above, the lighting device of one embodiment of the present invention can be used for various applications. Note that in the lighting device of one embodiment of the present invention, a desired display can be performed without an element such as a TFT in a light-emitting portion; thus, manufacturing process can be easy, yield is improved, and manufacturing cost can be reduced.

Note that the structure described in this embodiment can be combined as appropriate with any of the structures described in the other embodiments.

This application is based on Japanese Patent Application serial no. 2011-027135 filed with Japan Patent Office on Feb. 10, 2011, the entire contents of which are hereby incorporated by reference.

What is claimed is:

1. A lighting device comprising:

a connection terminal; and a light-emitting portion comprising a plurality of light-emitting segments arranged in matrix, wherein each of the plurality of light-emitting segments comprises an anode, a cathode, and an EL layer between the anode and the cathode, wherein an area of a first light-emitting segment of the plurality of light-emitting segments is different from that of a second light-emitting segment of the plurality of light-emitting segments, wherein the EL layer in the first light-emitting segment and the EL layer in the second light-emitting segment emit light of the same color, wherein the anodes of the light-emitting segments are separated from each other, wherein the cathodes of the first light-emitting segment, a third light-emitting segment of the plurality of light-emitting segments and a fourth light-emitting segment of the plurality of light-emitting segments are separated from each other, wherein the anode of the first light-emitting segment is electrically connected to the cathode of the third light-emitting segment, and wherein the cathode of the first light-emitting segment is electrically connected to the anode of the fourth light-emitting segment.

2. A lighting device according to claim 1, further comprising an insulating film between the EL layer and one of the anode and the cathode, wherein the insulating film has a plurality of openings, and wherein shapes of the plurality of openings correspond one-to-one with those of the plurality of light-emitting segments.

3. A lighting device according to claim 1, wherein an image, a design, a color, or a combination thereof is displayed on the light-emitting portion by emitting light from the plurality of light-emitting segments.

4. A lighting device according to claim 1, wherein a color of light of the third light-emitting segment is different from that of the fourth light-emitting segment, and wherein an image, a design, a color, or a combination thereof is displayed on the light-emitting portion by emitting light from the plurality of light-emitting segments.

5. The lighting device according to claim 1, wherein a color filter is provided in a position overlapping with each of the plurality of light-emitting segments, and wherein the EL layer comprises a material exhibiting a white light emission.

6. The lighting device according to claim 1, wherein the EL layer of the third light-emitting segment of the plurality of light-emitting segments comprises a first material exhibiting light emission of a first color, and wherein the EL layer of the fourth light-emitting segment comprises a second material exhibiting light emission of a second color different from the first color.

7. The lighting device according to claim 1, wherein the EL layer of the first light-emitting segment comprises a first material exhibiting light emission of a first color, and wherein the EL layer of the third light-emitting segment comprises a second material exhibiting light emission of a second color different from the first color.

8. The lighting device according to claim 1, further comprising an auxiliary wiring electrically connected to the connection terminal.

9. A lighting device comprising:

a light-emitting portion over a first substrate, the light-emitting portion comprising a plurality of light-emitting segments arranged in matrix;

a connecting terminal over the first substrate and electrically connected to the plurality of light-emitting segments; and a second substrate facing the first substrate with the plurality of light-emitting segments interposed therebetween, wherein each of the plurality of light-emitting segments comprises an anode, a cathode, and an EL layer between the anode and the cathode, wherein an area of a first light-emitting segment of the plurality of light-emitting segments is different from that of a second light-emitting segment of the plurality of light-emitting segments, wherein the EL layer in the first light-emitting segment and the EL layer in the second light-emitting segment emit light of the same color, wherein the anodes of the light-emitting segments are separated from each other, wherein the cathodes of the first light-emitting segment, a third light-emitting segment of the plurality of light-emitting segments and a fourth light-emitting segment of the plurality of light-emitting segments are separated from each other, wherein the anode of the first light-emitting segment is electrically connected to the cathode of the third light-emitting segment, and wherein the cathode of the first light-emitting segment is electrically connected to the anode of the fourth light-emitting segment.

10. A lighting device according to claim 9, further comprising an insulating film between the EL layer and one of the anode and the cathode, wherein the insulating film has a plurality of openings, and wherein shapes of the plurality of openings correspond one-to-one with those of the plurality of light-emitting segments.

11. A lighting device according to claim 9, wherein an image, a design, a color, or a combination thereof is displayed on the light-emitting portion by emitting light from the plurality of light-emitting segments.

12. A lighting device according to claim 9, wherein a color of light of the third light-emitting segment is different from that of the fourth light-emitting segment, and wherein an image, a design, a color, or a combination thereof is displayed on the light-emitting portion by emitting light from the plurality of light-emitting segments.

13. The lighting device according to claim 9, wherein the EL layer of the third light-emitting segment of the plurality of light-emitting segments comprises a first material exhibiting light emission of a first color, and wherein the EL layer of the fourth light-emitting segment comprises a second material exhibiting light emission of a second color different from the first color.

14. The lighting device according to claim 9, further comprising a light extraction structure with unevenness attached to the first substrate.

* * * * *

UNITED STATES PATENT AND TRADEMARK OFFICE

CERTIFICATE OF CORRECTION

PATENT NO. : 8,816,581 B2
APPLICATION NO. : 13/367886
DATED : August 26, 2014
INVENTOR(S) : Kaoru Hatano It is certified that error appears in the above-identified patent and that said Letters Patent is hereby corrected as shown below:

In the Specification:

Column 1, Line 17; Change "faun," to --form,--.

Column 4, Line 9; Change "farmed" to --formed--.

Column 7, Lines 9 thru 10; Change "N-[4-(9,10-diphenyl-2-anthryl)phenyl]-N,N',N''-triphenyl-1,4-phenylenediamine (abbreviation: 2DPAPPA),"
to --*N*-[4-(9,10-diphenyl-2-anthryl)phenyl]-*N,N',N'*-triphenyl-1,4-phenylenediamine (abbreviation: 2DPAPPA),"--.

Column 7, Lines 33 thru 36; Change "2-{2-isopropyl-6-[2-(1,1,7,7-tetramethyl-2,3,6,7-tetrahydro-1H,5H-benzo quinolizin-9-yl)ethenyl]-4H-pyran-4-ylidene}propanedinitrile (abbreviation: DCJTI),"
to --2-{2-isopropyl-6-[2-(1,1,7,7-tetramethyl-2,3,6,7-tetrahydro-1*H*,5*H*-benzo[*ij*]quinolizin-9-yl)ethenyl]-4*H*-pyran-4-ylidene}propanedinitrile (abbreviation: DCJTI),--.

Column 7, Lines 49 thru 51; Change "bis[2-(4',6'-difluorophenyppyridinato-$C^{2'}$]iridium(III)picolinate (abbreviation: FIrpic),"
to --bis[2-(4',6'-difluorophenyl)pyridinato- $N,C^{2'}$]iridium(III)picolinate (abbreviation: FIrpic),--.

Column 9, Lines 21 thru 22; Change "N,N'-bis(3-methylphenyl)-N,N'-diphenyl[1,1'-biphenyl]-4,4'-diamine (abbreviation: TPD),"
to --N,N'-bis(3-methylphenyl)-*N,N'*-diphenyl-[1,1'-biphenyl]-4,4'-diamine (abbreviation: TPD),--.

Signed and Sealed this
Thirtieth Day of December, 2014

Michelle K. Lee

Michelle K. Lee
*Deputy Director of the United States Patent and Trademark Office*